US010113498B2

(12) United States Patent
Mancini et al.

(10) Patent No.: US 10,113,498 B2
(45) Date of Patent: Oct. 30, 2018

(54) METHOD TO CONTROL A FUEL PUMP FOR A DIRECT INJECTION SYSTEM

(71) Applicant: MAGNETI MARELLI S.p.A., Corbetta (IT)

(72) Inventors: Luca Mancini, Budrio (IT); Paolo Pasquali, Castelmaggiore (IT); Riccardo Marianello, Monte San Pietro (IT)

(73) Assignee: MAGNETI MARELLI S.p.A., Corbetta (IT)

( * ) Notice: Subject to any disclaimer, the term of this patent is extended or adjusted under 35 U.S.C. 154(b) by 0 days.

(21) Appl. No.: 15/592,420

(22) Filed: May 11, 2017

(65) Prior Publication Data

US 2017/0328295 A1 Nov. 16, 2017

(30) Foreign Application Priority Data

May 12, 2016 (IT) ..... 102016000048975

(51) Int. Cl.
*F02D 41/30* (2006.01)
*F02D 41/38* (2006.01)
*F02M 55/02* (2006.01)

(52) U.S. Cl.
CPC ..... *F02D 41/3082* (2013.01); *F02D 41/3845* (2013.01); *F02M 55/025* (2013.01); *F02D 2200/0602* (2013.01)

(58) Field of Classification Search
CPC ..... F02D 41/3082; F02D 41/3845; F02D 2200/0602; F02M 55/025
See application file for complete search history.

(56) References Cited

U.S. PATENT DOCUMENTS 6,142,747 A * 11/2000 Rosenau ..... F02M 63/0225 123/446
7,463,967 B2 * 12/2008 Ancimer ..... F02D 19/10 123/480

(Continued)

FOREIGN PATENT DOCUMENTS

EP 1195514 A2 4/2002
EP 2011997 A1 1/2009

(Continued)

OTHER PUBLICATIONS

Italian Search Report dated Jan. 27, 2017 for Italian Patent Application No. UA20163392 (6 pages).

*Primary Examiner* — Long T Tran
*Assistant Examiner* — Xiao Mo
(74) *Attorney, Agent, or Firm* — Howard & Howard Attorneys PLLC

(57) ABSTRACT

A method to control a fuel pump for a direct injection system provided with a common rail comprising the steps of calculating the objective fuel flow rate to be fed by the high pressure pump to the common rail instant by instant to have the desired pressure value inside the common rail; comparing the objective fuel flow rate with the maximum flow rate that can be delivered by the high pressure pump; and, based on the comparison between the objective fuel flow rate and the maximum flow rate that can be delivered by the high pressure pump, controlling the high pressure pump so as to alternate operating cycles of the high pressure pump with the maximum flow rate that can be delivered and idle operating cycles of the high pressure pump.

4 Claims, 4 Drawing Sheets

(56) References Cited

U.S. PATENT DOCUMENTS

| | | | | |
|---|---|---|---|---|
| 8,245,694 | B2 * | 8/2012 | Kuhnke | F02M 47/027 123/447 |
| 2002/0170539 | A1 * | 11/2002 | Rembold | F02M 55/04 123/458 |
| 2009/0068041 | A1 * | 3/2009 | Beardmore | F02M 55/04 417/540 |
| 2010/0101538 | A1 * | 4/2010 | Beardmore | F02M 59/102 123/495 |

FOREIGN PATENT DOCUMENTS

| | | | |
|---|---|---|---|
| EP | 2039920 | A1 | 3/2009 |
| EP | 2508744 | A1 | 10/2012 |

* cited by examiner

METHOD TO CONTROL A FUEL PUMP FOR A DIRECT INJECTION SYSTEM

PRIORITY CLAIM

This application claims priority from Italian Patent Application No. 102016000048975 filed on May 12, 2016, the disclosure of which is incorporated by reference.

TECHNICAL FIELD

The invention relates to a method to control a fuel pump for a direct injection system. Preferably (though not necessarily), the control method is used for a direct injection system in spark-ignition internal combustion engine, which, thus, works with gasoline or similar fuels.

PRIOR ART

As it is known, a fuel—in this specific case gasoline—direct injection system of the common rail type for an internal combustion heat engine comprises a plurality of injectors, a common rail, which feeds pressurized fuel to the injectors, a high pressure pump, which feeds fuel to the common rail and is provided with a flow-rate adjusting device, a control unit, which causes the fuel pressure inside the common rail to be equal to a desired value, which generally varies in time as a function of the engine operating conditions, and a low-pressure pump, which feeds fuel from a tank to the high pressure pump by means of a feeding duct.

The control unit is coupled to the flow-rate adjusting device so as to control the flow-rate of the high pressure pump, so that the common rail is supplied, instant by instant, with the amount of fuel necessary to have the desired pressure value in the common rail; in particular, the control unit adjusts the flow-rate of the high pressure pump by means of a feedback control, which uses, as a feedback variable, the value of the fuel pressure inside the common rail.

The operating cycle of the high pressure pump substantially comprises three phases: an intake phase, in which to allow the passage of a fuel flowing into a pumping chamber of the high pressure pump; a reflux phase, during which there is a passage of fuel flowing out of the pumping chamber towards the low-pressure circuit; and a pumping phase, during which the fuel pressure inside the pumping chamber reaches a values that is such as to cause a fuel flow flowing out of the pumping chamber towards the common rail.

Experiments have shown that, during the pumping phase, there is a significant increase in the temperature of the high pressure pump 4. In particular, when there is a pressure increase from 200 to 600 bar, the temperature variation ranges from 30 to 50° C. in the different points of the high pressure pump, whereas, in case there is a pressure increase from 600 to 800 bar, the temperature variation assumes much more significant values in the range of 80° C. While a temperature variation ranging from 30 to 50° C. could lead to cavitation problems for the high pressure pump, in case of a temperature variation in the range of 80° C. the high pressure pump becomes definitely unstable and scarcely reliable.

In order to try and limit the temperature increase of the high pressure pump during the pumping phase, different solutions were suggested.

For example, one suggested solution involves increasing the fuel pressure as it flows into the high pressure pump. In other words, the low-pressure pump should feed the fuel from the tank to the high pressure pump at a greater pressure value (compared to the current 5.5 bar), but this solution is characterized by negative effects, in terms of energy efficiency, for the low-pressure pump.

Alternatively, document EP2039920 describes a method to control a fuel pump for a direct injection system provided with a common rail comprising the steps of calculating the objective fuel flow rate to be fed by the high pressure pump to the common rail instant by instant to have the desired pressure value inside the common rail; and controlling the opening and the closing of a shut-off valve to choke the flow rate of fuel taken in by the fuel pump and adjusting the flow rate of fuel taken in by the fuel pump by varying the ratio between the duration of the opening time and the duration of the closing time of said shut-off valve.

Alternatively, another suggested solution involves providing the high pressure pump with a fuel recirculation circuit, already used in Diesel injection systems, which is provided with an exhaust pipe that transfers a fuel portion from the pumping chamber to the tank. By so doing, the heat generated during the pumping phase is drained through the fuel flow rate flowing out of the high pressure pump: however, this technical solution is affected by significant drawbacks in terms of overall dimensions of the injections system and is also expensive.

DESCRIPTION OF THE INVENTION

An object of the invention is to provide a method to control a fuel pump for a direct injection system, said method being free from the drawbacks of the prior art and, at the same time, easy and cheap to be implemented.

According to the invention, there is provided a method to control a fuel pump for a direct injection system according to the appended claims.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
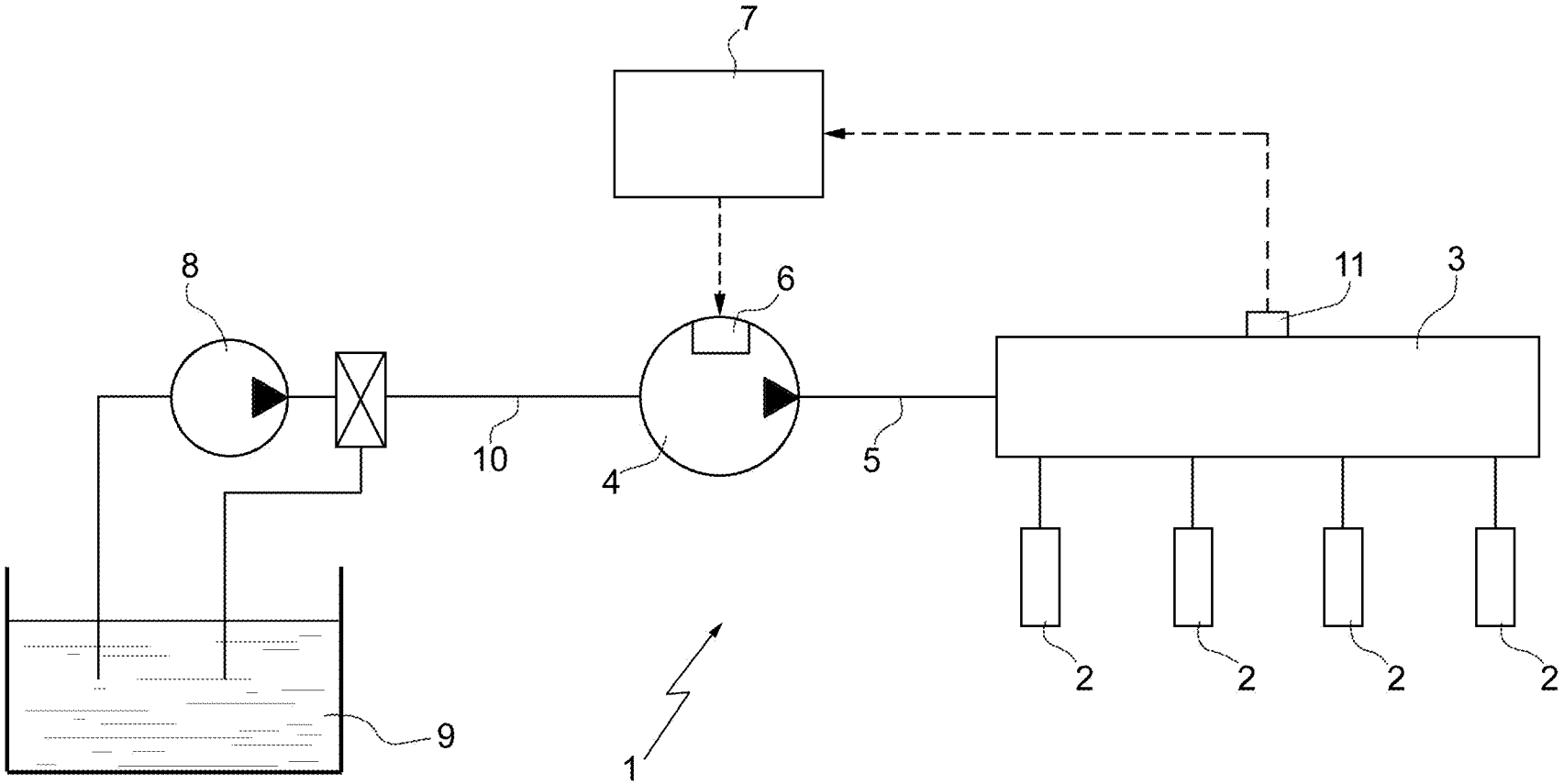
FIG. 1 is a schematic view, with some details removed for greater clarity, of a fuel direct injection system of the common rail type.

In FIG. 1, number 1 indicates, as a whole, a common-rail, fuel direct injection system, in particular using gasoline as a fuel, for an internal combustion engine ICE.

The direct injection system 1 comprises a plurality of injectors 2, a common rail 3, which feeds pressurized fuel to the injectors 2, a high pressure pump 4, which feeds fuel to the common rail 3 by means of a feeding duct 5 and is provided with a flow-rate adjusting device 6, a control unit 7, which causes the fuel pressure inside the common rail 3 to be equal to a desired value, which generally varies in time as a function of the engine operating conditions, and a low-pressure pump 8, which feeds fuel from a tank 9 to the high pressure pump 4 by means of a feeding duct 10.

The control unit 7 is coupled to the flow-rate adjusting device 6 so as to control the flow-rate of the high pressure pump 4, so that the common rail 3 is supplied, instant by instant, with the amount of fuel necessary to have the desired pressure value in the common rail 3; in particular, the control unit 7 regulates the flow-rate of the high pressure pump 4 by means of a feedback control, which uses, as a feedback variable, the value of the fuel pressure inside the common rail 3, the value of the pressure being detected, in real time, by a pressure sensor 11.

Figure 2:
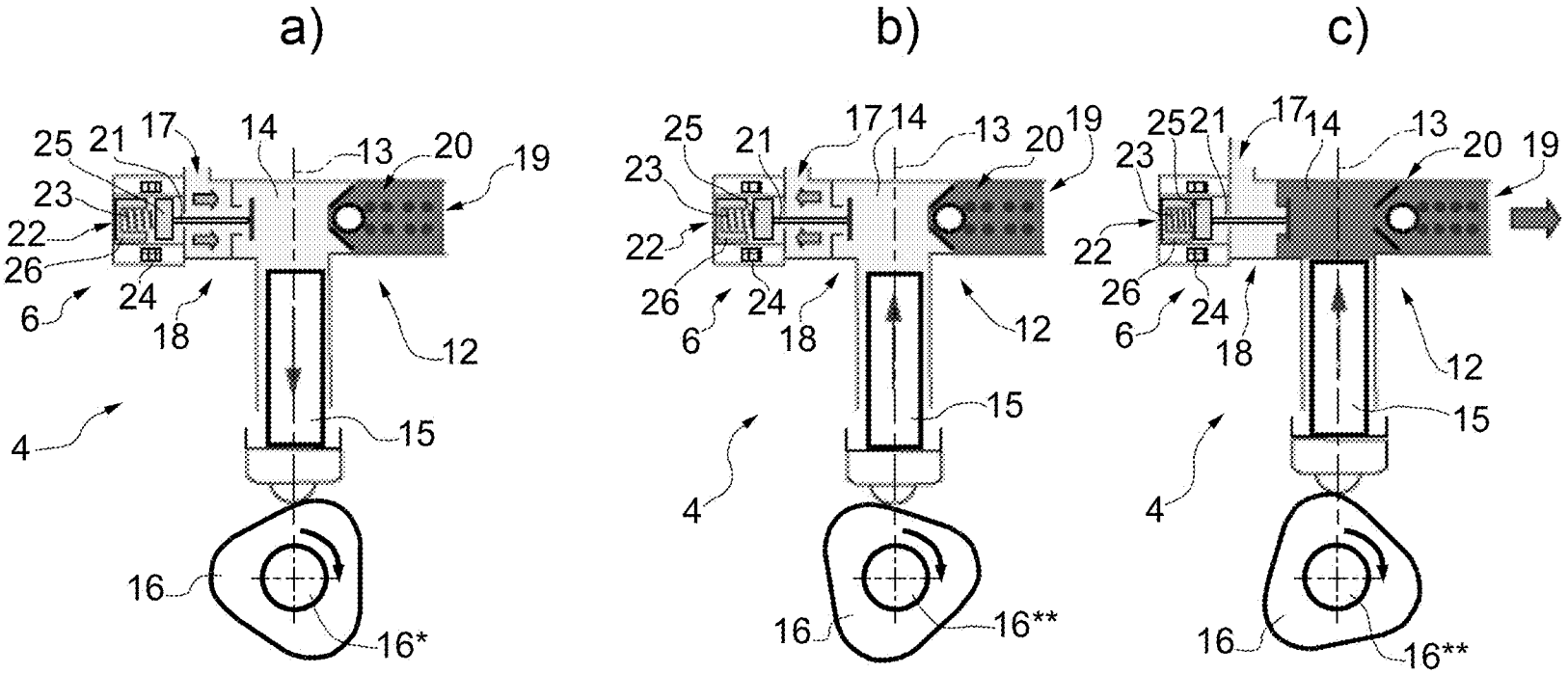
FIG. 2 is a longitudinal section view, namely a schematic view with some details removed for greater clarity, of a high pressure fuel pump of the direct injection system of FIG. 1.

As schematically shown in FIG. 2, the high pressure pump 4 comprises a main body 12, which has a longitudinal axis 13 and defines, on the inside, a cylindrical pumping chamber 14. A piston 15 is mounted and slides inside the pumping chamber 14, and, as it slides back and forth along the longitudinal axis 13 due to the action of the lobes 16 of a camshaft 16*, it determines a cyclical change in the volume of the pumping chamber 14. A lower portion of the piston 15 is coupled to a spring (not shown), which, on one side, pushes the piston 15 towards a position producing a maximum volume of the pumping chamber 14, and, on the other side, is coupled to the camshaft 16*, which is caused to rotate by a drive shaft (not shown) of the engine so as to cyclically to move the piston 15 upwards compressing the spring 16.

An intake channel 17 originates from a lateral wall of the pumping chamber 14, said intake channel 17 being connected to the low-pressure pump 8 by means of the feeding duct 10 and being regulated by an intake valve 18, which is arranged in the area of the pumping chamber 14. The intake valve 18 is normally pressure-controlled and, in the absence of external intervention, is closed when the fuel pressure in the pumping chamber 14 is higher than the fuel pressure in the intake channel 17, and is open when the fuel pressure in the pumping chamber 14 is lower than the fuel pressure in intake channel 17.

A delivery channel 19 originates from a lateral wall of the pumping chamber 14 on the opposite side relative to the intake channel 17, said delivery channel 19 being connected to the common rail 3 by means of the feeding duct 5 and being regulated by a one-way delivery valve 20, which is arranged in the area of the pumping chamber 14 and only allows fuel to flow out of the pumping chamber 14. The delivery valve 20 is normally pressure-controlled and is open when the fuel pressure in the pumping chamber 14 is higher than the fuel pressure in delivery channel 19, and is closed when the fuel pressure in the pumping chamber 14 is lower than the fuel pressure in delivery channel 19.

The flow-rate adjusting device 6 is mechanically coupled to the intake valve 18 so as to allow the control unit 7, when necessary, to keep the intake valve 18 open during a reflux phase RP of the piston 15, thus allowing the fuel to flow out of the pumping chamber 14 through the intake channel 17 (as we will better explain below).

The flow-rate adjusting device 6 comprises a control rod 21, which is coupled to the intake valve 18 and is movable between a passive position, in which it allows the intake valve 18 to close and the hydraulic communication between the pumping chamber 14 and the intake channel 17 is cut off, and an active position, in which it does not allow the intake valve to close and the hydraulic communication between the pumping chamber 14 and the intake channel 17 is enabled. The flow-rate adjusting device 6 comprises, furthermore, an electromagnetic actuator 22, which is coupled to the control rod 21 so as to move it between the active position and the passive position.

The electromagnetic actuator 22 comprises a spring 23, which holds the control rod 21 in the active position, and an electromagnet 24, which is controlled by the control unit 7 and is designed to move the control rod 21 to the passive position by magnetically attracting a ferromagnetic anchor 25, which is integral to the control rod 21. When the electromagnet 24 is energized, the control rod 21 is moved back to the passive position and the communication between the intake channel 17 and the pumping chamber 14 can be cut off by closing the intake valve 18. The electromagnet 24 comprises a fixed magnetic armature 26 (or magnetic bottom), which is surrounded by a coil; when an electric current flows through it, the coil generates a magnetic field that magnetically attracts the anchor 25 towards the magnetic armature 26. The control rod 21 and the anchor 25 form, together, a movable equipment of the flow-rate adjusting device 6, which axially moves between the active position and the passive position, always controlled by the electromagnetic actuator 22. The magnetic armature 26 preferably has an annular shape with a central hole, so as to have a central empty space that can house the spring 23.

According to a preferred embodiment, the electromagnetic actuator 22 comprises a one-way hydraulic brake, which is integral to the control rod 21 and is designed to slow down the movement of the movable equipment (i.e. of the control rod 21 and of the anchor 25) only when the movable equipment moves towards the active position (namely, the hydraulic brake does not slow down the movement of the movable equipment when the movable equipment moves towards the passive position).

The electromagnetic actuator 22 is controlled by the control unit 7 and is powered with an electric current curve that is substantially synchronous with the top dead centre of the high pressure pump 4. In particular, the control unit 7 transmits electric current pulses, whose duration can vary depending on the operating point of the internal combustion engine, namely of its speed, whereas the timing of said electric current pulses can vary depending on the fuel flow-rate flowing out of the pumping chamber 14.

The operating cycle of the high pressure pump 4 substantially comprises three phases. The operating cycle of the high pressure pump 4 is identified by each one of the lobes 16 of the camshaft 16*, which determines a cyclical change in the volume of the pumping chamber 14.

An intake phase (shown in FIG. 2*a*), which begins in the area of the top dead centre PTDC of the high pressure pump 4. During the intake phase, the piston 15 moves downwards along the longitudinal axis 13, the intake valve 18 is open and the control rod 21 is in the active position, so as to allow fuel to flow into the pumping chamber 14 through the intake channel 17.

A reflux phase (shown in FIG. 2*b*) follows the intake phase SP of the high pressure pump 4 and starts in the area of the bottom dead centre PTDC of the high pressure pump 4. During the reflux phase, the piston 15 moves upwards along the longitudinal axis 13, the intake valve 18 is kept open and the control rod 21 is in the active position. In this way, the fuel flowing out of the pumping chamber 14 flows through the intake channel 17 and towards the low-pressure circuit.

Finally, a pumping phase (shown in FIG. 2*c*) follows the reflux phase of the high pressure pump 4. The pumping phase of the high pressure pump 4 begins in the area of the command of the control unit 7 that powers the electromagnetic actuator 22 with an electric current pulse. The intake valve 18 is closed due to the reflux of the fuel that flows out of the pumping chamber 14 through the intake channel 17 and towards the low-pressure circuit. After the intake valve 18 has been closed, the fuel pressure inside the pumping chamber 14 reaches a value that is such as to cause the opening of the one-way delivery valve 20, which is arranged in the area of the pumping chamber 14 and allows fuel to flow out of the pumping chamber 14. In other words, the opening of the one-way delivery valve 20 takes place when the fuel pressure inside the pumping chamber 14 is higher than the fuel pressure in the delivery channel 19.

When, in use, the movable equipment (namely, the control rod 21 and the anchor 25) of the flow-rate adjusting device 6 moves towards the passive position, thus moving away from the active position and allowing the intake valve 18 to close so as to start feeding pressurized fuel to the common rail 3, the movement towards the passive position has a substantial effect on the operation of the high pressure pump 4 and, therefore, must be as quick as possible, so as to facilitate and improve control. Since the kinetic energy of the movable equipment at the moment of the impact against the magnetic armature 26 is a function of the square of the speed, this kinetic energy is substantially great.

Experiments have shown that, during the pumping phase, there is a significant increase in the temperature of the high pressure pump 4.

Figure 3:
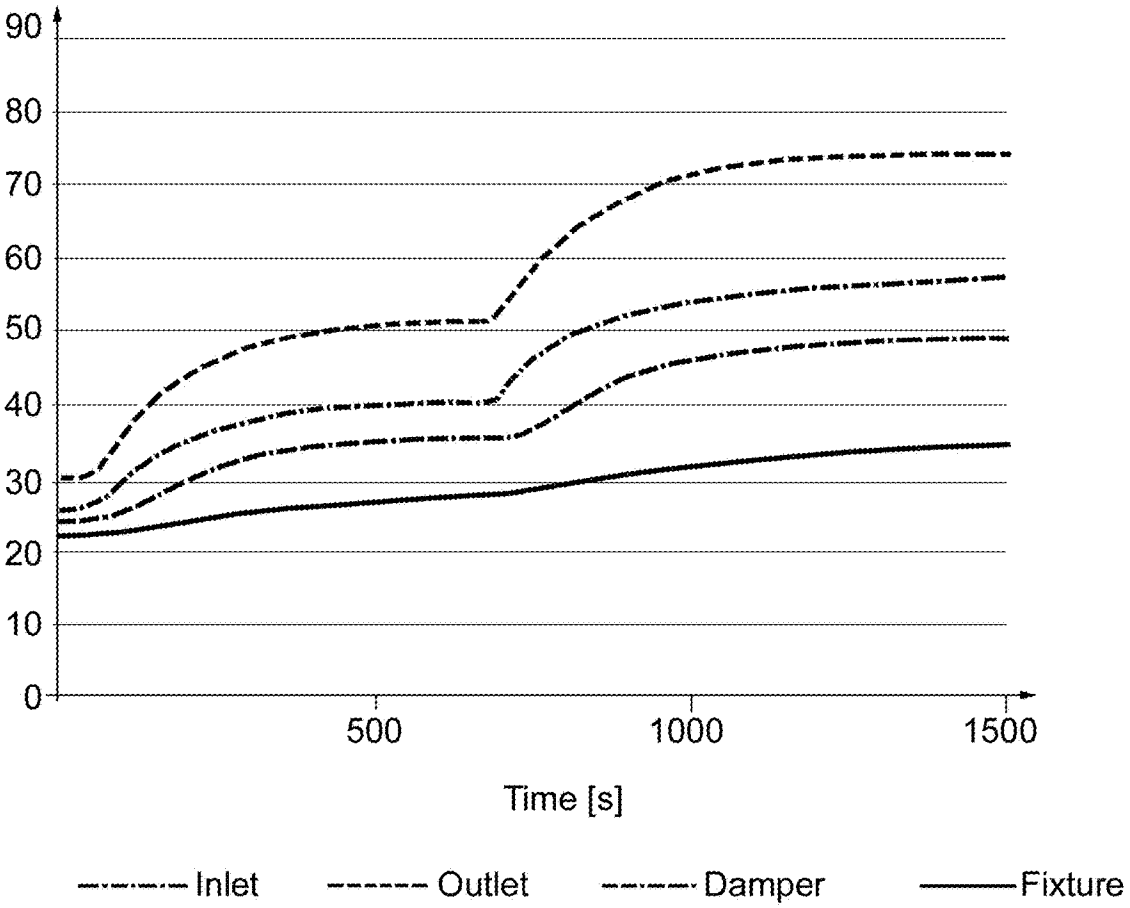
FIGS. 3 and 4 show the development in time of the temperature inside the high pressure fuel pump of FIG. 2.

In particular, the diagram shown in FIG. 3 shows the variation in time of the temperature detected in the area of four points of the high pressure pump 4. More in detail, INLET indicates the variation in time of the temperature measured in the area of the intake channel 10, OUTLET indicates the variation in time of the temperature measured in the area of the delivery channel 19, DAMPER indicates the variation in time of the temperature measured in the area of the channel 17, whereas FIXTURE indicates the variation in time of the temperature measured in the area of a support 27 of the high pressure pump 4.

The four developments of the temperature detected in the area of the different points of the high pressure pump 4 are substantially similar and have two sharp variations in the area of a pressure increase $\Delta p$ from 200 to 600 bar and in the area of a pressure increase $\Delta p$ from 600 to 800 bar.

In particular, according to FIG. 3, in case, following the closing of the intake valve 18, there is a pressure increase $\Delta p$ from 200 to 600 bar, the temperature variation $\Delta T$ ranges from 30 to 50° C. in the area of the different points of the high pressure pump 4. On the other hand, in case, following the closing of the intake valve 18, there is a pressure increase $\Delta p$ from 600 to 800 bar, the temperature variation $\Delta T$ assumes greater values in the range of 80° C. While a temperature variation $\Delta T$ ranging from 30 to 50° C. could lead to cavitation problems for the high pressure pump 4, in case of a temperature variation $\Delta T$ in the range of 80° C. the high pressure pump becomes definitely unstable and scarcely reliable.

It has been proved that this phenomenon worsens in case the high pressure pump does not work with a full load, i.e. in case the fuel quantity needed to have the desired pressure value inside the common rail 3 and fed by the high pressure pump 4 is lower than the maximum flow rate $M_{max}$ that can be delivered by the high pressure pump 4.

In case the high pressure pump 4 operates with a full load (namely, in case the fuel quantity needed to have the desired pressure value inside the common rail 3 and fed by the high pressure pump 4 is equal to the maximum flow rate $M_{max}$ that can be delivered by the high pressure pump 4), the heat generated during the pumping phase is drained through the fuel flow rate flowing out of the high pressure pump 4.

Therefore, the control unit 7 is designed to control the high pressure pump 4 so as to contain the temperature variation $\Delta T$ generated during the pumping phase in the high pressure pump 4.

Hereinafter you can find a description of the strategy implemented by the control unit 7 in order to control the high pressure pump 4 so as to contain the temperature variation $\Delta T$ generated during the pumping phase in the high pressure pump 4.

First of all, the strategy involve calculating the objective fuel flow rate $M_{ref}$ to be fed by the high pressure pump 4 to the common rail 3 instant by instant to have the desired pressure value inside the common rail 3.

Then, the control unit 7 is designed to compare the objective fuel flow rate $M_{ref}$ with the maximum flow rate $M_{max}$ that can be delivered by the high pressure pump 4. In case the difference between the objective fuel flow rate $M_{ref}$ and the maximum flow rate $M_{max}$ that can be delivered by the high pressure pump is irrelevant (or, anyway, lower than a threshold value TV that can be adjusted during a set up phase of the control unit 7), no strategy is implemented in order to control the high pressure pump 4 so as to contain the temperature variation $\Delta T$ generated during the pumping phase in the high pressure pump 4.

In case the difference between the objective fuel flow rate $M_{ref}$ and the maximum flow rate $M_{max}$ that can be delivered by the high pressure pump is not irrelevant and, in particular, exceeds and adjustable threshold value TV, a strategy is implemented, which is aimed at containing the temperature variation $\Delta T$ generated during the pumping phase in the high pressure pump 4.

The control unit 7 is designed to adjust the flow rate of the high pressure pump 4 so as to process the maximum flow rate $M_{max}$ that can be delivered by the high pressure pump 4. In other words, the control unit 7 is designed to control the alternation of operating cycles, in which the high pressure pump 4 processes the maximum flow rate $M_{max}$ that can be delivered by the high pressure pump 4, and idle operating cycles.

In particular, the control unit 7 is designed to control exclusively the alternation of two operating cycles: operation cycles in which the high pressure pump 4 processes the maximum flow rate $M_{max}$ that can be delivered by the high pressure pump 4, and idle operating cycles.

For example, in case the objective fuel flow rate $M_{ref}$ to be fed by the high pressure pump 4 to the common rail 3 instant by instant to have the desired pressure value inside the common rail 3 is equal to half the maximum flow rate $M_{max}$ that can be delivered by the high pressure pump 4, the control unit 7 is designed to carry out an operating cycle of the high pressure pump 4 with the maximum flow rate $M_{max}$ that can be delivered by the high pressure pump 4 and the idle operating cycle of the high pressure pump 4. By so doing, the high pressure pump 4 can process the same fuel flow rate in the two operating cycles (equal to the maximum flow rate $M_{max}$ that can be delivered by the high pressure pump 4), but the heat generated during the idle operating cycle of the high pressure pump 4 is drained by the fuel flow rate flowing out of the high pressure pump 4 in the operating cycle of the high pressure pump 4 with the maximum flow rate $M_{max}$ that can be delivered.

Generally speaking, in case the objective fuel flow rate $M_{ref}$ to be fed by the high pressure pump 4 to the common rail 3 instant by instant to have the desired pressure value inside the common rail 3 is equal to a 1/n fraction of the maximum flow rate $M_{max}$ that can be delivered by the high pressure pump 4, the control unit 7 is designed to carry out an operating cycle of the high pressure pump 4 with the maximum flow rate $M_{max}$ that can be delivered by the high pressure pump 4 every n operating cycles of the high pressure pump 4, whereas the remaining (n−1) operating cycles will be idle operating cycles of the high pressure pump 4.

Hence, the control unit 7 is designed to control the high pressure pump 4 by means of a feedback control, which uses, as feedback variables, the value of the fuel pressure inside the common rail 3, preferably detected in real time by a pressure sensor 11, and the comparison between the maximum flow rate $M_{max}$ that can be delivered by the high pressure pump 4 and the objective fuel flow rate $M_{ref}$ to be fed by the high pressure pump 4 to the common rail 3 instant by instant to have the desired pressure value inside the common rail 3.

Figure 4:
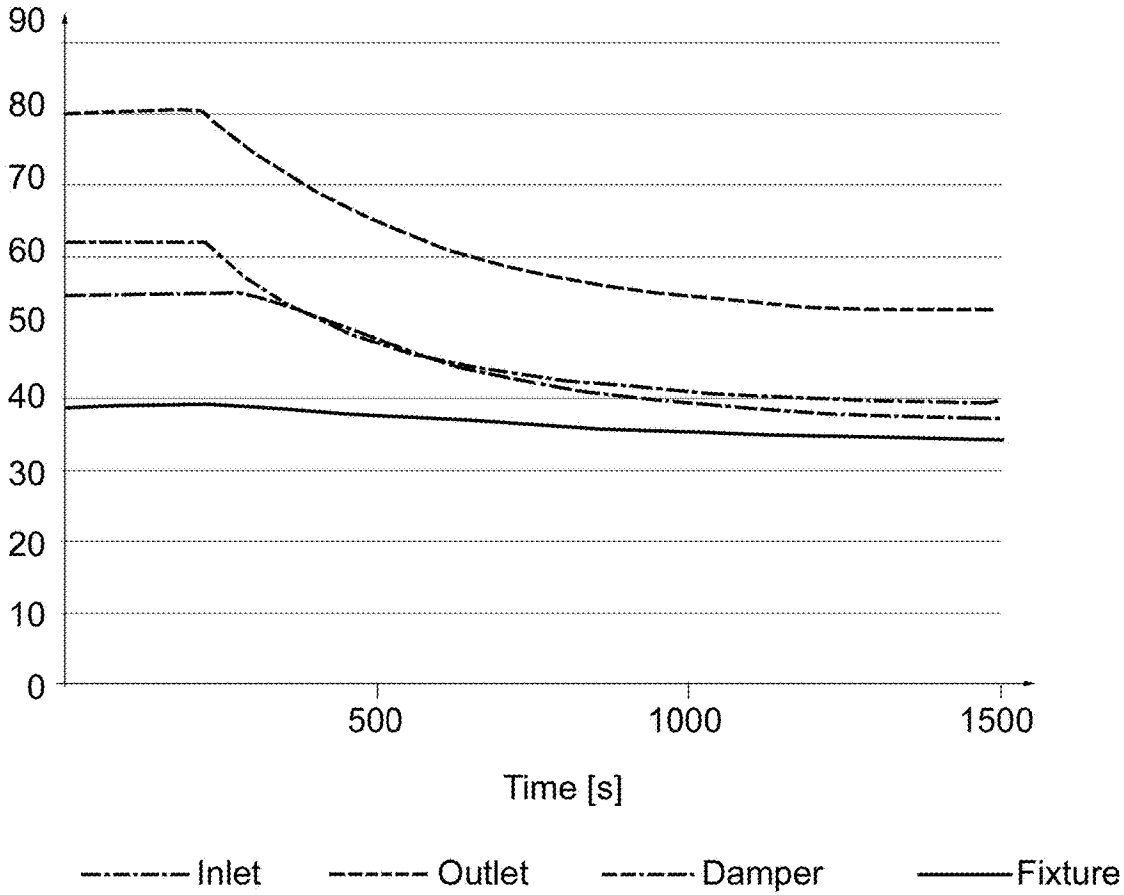

The diagram shown in FIG. 4 shows the variation in time of the temperature detected in the area of four points of the high pressure pump 4 implementing the control strategy of the high pressure pump 4 described above. More in detail, INLET indicates the variation in time of the temperature measured in the area of the intake channel 10, OUTLET indicates the variation in time of the temperature measured in the area of the delivery channel 19, DAMPER indicates the variation in time of the temperature measured in the area of the channel 17, whereas FIXTURE indicates the variation in time of the temperature measured in the area of the support 27 of the high pressure pump 4.

The four developments of the temperature detected in the area of the different points of the high pressure pump 4 are substantially similar and have two slight variations in the area of a pressure increase Δp from 200 to 600 bar and in the area of a pressure increase Δp from 600 to 800 bar. In particular, according to FIG. 4, in case, following the closing of the intake valve 18, there is a pressure increase Δp from 200 to 600 bar, the temperature variation ΔT ranges from 30 to 40° C. in the area of the different points of the high pressure pump 4. On the other hand, in case, following the closing of the intake valve 18, there is a pressure increase Δp from 600 to 800 bar, the temperature variation ΔT assumes higher values that, anyway, are lower than 50° C.

The strategy implemented by the control unit 7 to control the high pressure pump 4 and described so far has some advantages. In particular, despite being advantageous in terms of costs, it is also easy and cheap to be implemented. In particular, the method described above does not involve an excessive computing burden for the control unit 7, permitting at the same time a limitation of the temperature variation ΔT generated during the pumping phase in the high pressure pump 4 and maintaining the fuel pressure objective value inside the common rail 3.

The invention claimed is:

1. A method to control a high pressure pump (4) for a direct injection system provided with a common rail (3) comprising the steps of:

calculating an objective fuel flow rate ($M_{ref}$) to be fed by the high pressure pump (4) to the common rail (3) instant by instant to have the desired pressure value inside the common rail (3);

comparing the objective fuel flow rate ($M_{ref}$) with the maximum flow rate ($M_{max}$) that can be delivered by the high pressure pump (4); and based on the comparison between the objective fuel flow rate ($M_{ref}$) and the maximum flow rate ($M_{max}$) that can be delivered by the high pressure pump (4), controlling the high pressure pump (4) so as to alternate exclusively operating cycles of the high pressure pump (4) with the maximum flow rate ($M_{max}$) that can be delivered and idle operating cycles of the high pressure pump (4).

2. A method according to claim 1 and comprising the further steps of detecting in real time the desired pressure value inside the common rail (3); and controlling the high pressure pump (4) based on the pressure value detected inside the common rail (3).

3. A method according to claim 1 and comprising the further step of controlling the high pressure pump (4) so as to alternate operating cycles of the high pressure pump (4) with the maximum flow rate ($M_{max}$) that can be delivered and idle operating cycles of the high pressure pump (4) only in case the difference between the maximum flow rate ($M_{max}$) that can be delivered by the high pressure pump (4) and the objective fuel flow rate ($M_{ref}$) exceeds a threshold value (TV).

4. A method according to claim 1, wherein, in case the objective fuel flow rate ($M_{ref}$) is equal to 1/n of the maximum flow rate ($M_{max}$) that can be delivered by the high pressure pump (4), the method comprises the further step of controlling an operating cycle of the high pressure pump (4) with the maximum flow rate ($M_{max}$) that can be delivered and (n−1) idle operating cycles of the high pressure pump (4).

* * * * *